US006202355B1

(12) United States Patent
Uram et al.

(10) Patent No.: US 6,202,355 B1
(45) Date of Patent: Mar. 20, 2001

(54) RETRACTABLE LOAD-BEARING COVER

(76) Inventors: Scott Uram, 19440 E. Trioak Cir., Wyoming, MN (US) 55092; Judd Jackson, 5939 Egg Lake Rd., Hugo, MN (US) 55038

( * ) Notice: Subject to any disclaimer, the term of this patent is extended or adjusted under 35 U.S.C. 154(b) by 0 days.

(21) Appl. No.: 09/339,739

(22) Filed: Jun. 24, 1999

(51) Int. Cl.[7] ..... E04D 5/00

(52) U.S. Cl. ..... 52/5; 52/3; 52/71; 52/169.7; 4/498; 4/503

(58) Field of Search ..... 52/5, 3, 71, 169.7; 4/498, 503

(56) References Cited

U.S. PATENT DOCUMENTS

| | | | | |
|---|---|---|---|---|
| 2,085,436 | * | 6/1937 | Maurer | 52/71 |
| 3,118,148 | | 1/1964 | Taylor et al. . | |
| 3,466,830 | * | 9/1969 | Smith | 52/71 |
| 3,683,428 | * | 8/1972 | Morris | 4/172.14 |
| 3,854,149 | * | 12/1974 | Mischke | 4/172.11 |
| 4,135,259 | | 1/1979 | Scardenzan . | |
| 4,192,025 | | 3/1980 | Hinsperger . | |
| 4,466,143 | * | 8/1984 | Lamb | 4/502 |
| 4,550,945 | * | 11/1985 | Englehardt | 52/71 |
| 4,598,506 | | 7/1986 | Nohl et al. . | |
| 4,628,646 | * | 12/1986 | Eyerle | 52/169.7 |
| 5,067,184 | | 11/1991 | Last . | |
| 5,086,872 | * | 2/1992 | Lin | 182/129 |
| 5,303,527 | | 4/1994 | Perez et al. . | |
| 5,394,660 | | 3/1995 | Haris . | |
| 5,678,253 | | 10/1997 | Baker . | |
| 5,740,562 | | 4/1998 | Nickalo . | |
| 5,819,332 | * | 10/1998 | Perry | 4/498 |
| 5,921,030 | * | 7/1999 | Ducotey et al. | 52/3 |
| 5,941,027 | * | 8/1999 | Hallsten | 52/5 |
| 6,079,059 | * | 6/2000 | Girerd | 4/498 |

* cited by examiner

*Primary Examiner*—Beth A. Stephan
*Assistant Examiner*—Dennis L. Dorsey
(74) *Attorney, Agent, or Firm*—Haugen Law Firm PLLP

(57) ABSTRACT

A retractable load-bearing cover includes a plurality of rigid panels hingedly attached one to the other to form a plurality of hinged panel pairs, adjoining hinged panel pairs being hingedly attached to an interconnecting support member. A first hinged panel pair is hingedly attachable at one end to a support structure and hingedly attachable at another end to a first interconnecting support member. A last hinged panel pair includes a distal panel hingedly attached to a terminating support member. In an extended position, upper surfaces of the panels are coplanar to provide a load-bearing surface upon which activities such as dancing and sporting activities can be performed. The cover is retractable in an accordion configuration wherein each hinged panel pair abuts against an adjoining panel pair.

8 Claims, 3 Drawing Sheets

10
12
14
16
18
20
22
24
26
28
29
56
60
62
64

RETRACTABLE LOAD-BEARING COVER

BACKGROUND OF THE INVENTION

1. Field of the Invention

The present invention relates to retractable covers and more particularly pertains to a retractable load-bearing cover for use in covering in an extended position and uncovering in a retracted position an area such as a swimming pool or ice skating surface to provide a load-bearing surface in the extended position. In the retracted position the retractable cover is foldable in accordion fashion adjacent the area to be covered.

2. Description of the Prior Art

Retractable swimming pool covers available on the market typically include a fabric which is sized so that most of it floats on the water surface of the swimming pool. While such covers arguably protect children and animals from falling into the pool, they do not provide a load-bearing surface capable of supporting human activities such as dancing and sporting activities. Furthermore, such covers are not adapted to cover other areas such as ice skating surfaces.

The problem of providing a load-bearing surface for such a covering has been addressed in the prior art as disclosed in U.S. Pat. No. 4,135,259 to Scardenzan. The Scardenzan device includes a rigid deck member which fits over the top of the pool and which is lifted clear of the top of the pool by a hydraulic cylinder and linkage coupling the hydraulic cylinder to the deck member. The device suffers from the disadvantage of requiring a housing located to one side of the pool to accommodate the hydraulic components and linkage. Additionally, the deck member in its upper position shades a portion of the pool and the area adjacent the pool.

A removable pool cover support apparatus is disclosed in U.S. Pat. No. 5,303,527 to Perez et al. A plurality of adjustable frame assemblies capable of spanning opposite edges of a pool are secured one to the other such that the frame assembly will span the pool between its opposite sides. A framework overlying and supported by the frame assemblies spans across the length and width of the swimming pool for, in turn, supporting a pool cover. The Perez et al. apparatus thus requires extensive on-site assembly.

A combination indoor swimming pool cover and support floor is disclosed in U.S. Pat. No. 4,598,506 to Nohl et al. When in place the cover provides a continuation of the floor and when raised vertically becomes a false ceiling. A hoist mechanism is stored in a crawl space or attic above the normal ceiling. The cover is specifically designed for an indoor pool.

A foldable pool cover is disclosed in U.S. Pat. No. 3,118,148 to Taylor et al. that includes a plurality of panels hinged to one another. The panels are formed of an upper and lower sheet for accommodation of hydrogen rich radiation shielding material therebetween to minimize the penetration of dangerous dosages of radiation through the panels. The panels are not shown to be load-bearing.

It would therefore be desirable to provide a retractable cover which is load-bearing and which is easily foldable in accordion fashion for storage adjacent the area to be covered.

SUMMARY OF THE INVENTION

Accordingly, it is a primary object of the present invention to provide a retractable cover which is load-bearing.

It is a further object of applicant's invention to provide a retractable cover which is foldable in accordion fashion for storage adjacent the area to be covered.

Various of the foregoing objects, advantages, and distinctions of the invention are particularly obtained in a retractable cover including a plurality of rigid hinged panels. The rigid panels are formed by welding or otherwise attaching a plurality of extruded aluminum beams together to form a panel of desired size, each panel having a flat upper surface. Adjoining pairs of hinged panels are hingedly attached to interconnecting support members having runner members disposed on opposite ends thereof. The runner members are adapted to slide along the edge of a swimming pool deck or other area to be covered. Alternatively, the runner members may include wheel means adapted to ride along the edge. A first pair of hinged panels has a first panel including a first edge hingedly attached to a support structure such as an upstanding wall. In an extended position the rigid panels form a load-bearing cover in which the panel flat upper surfaces are coplanar and in which the interconnecting support members span the width of the swimming pool or other area. In a retracted position, the cover is folded in accordion fashion with the first pair of hinged panels folded adjacent the support structure and adjoining hinged pairs folded sequentially against one another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 6, 7:
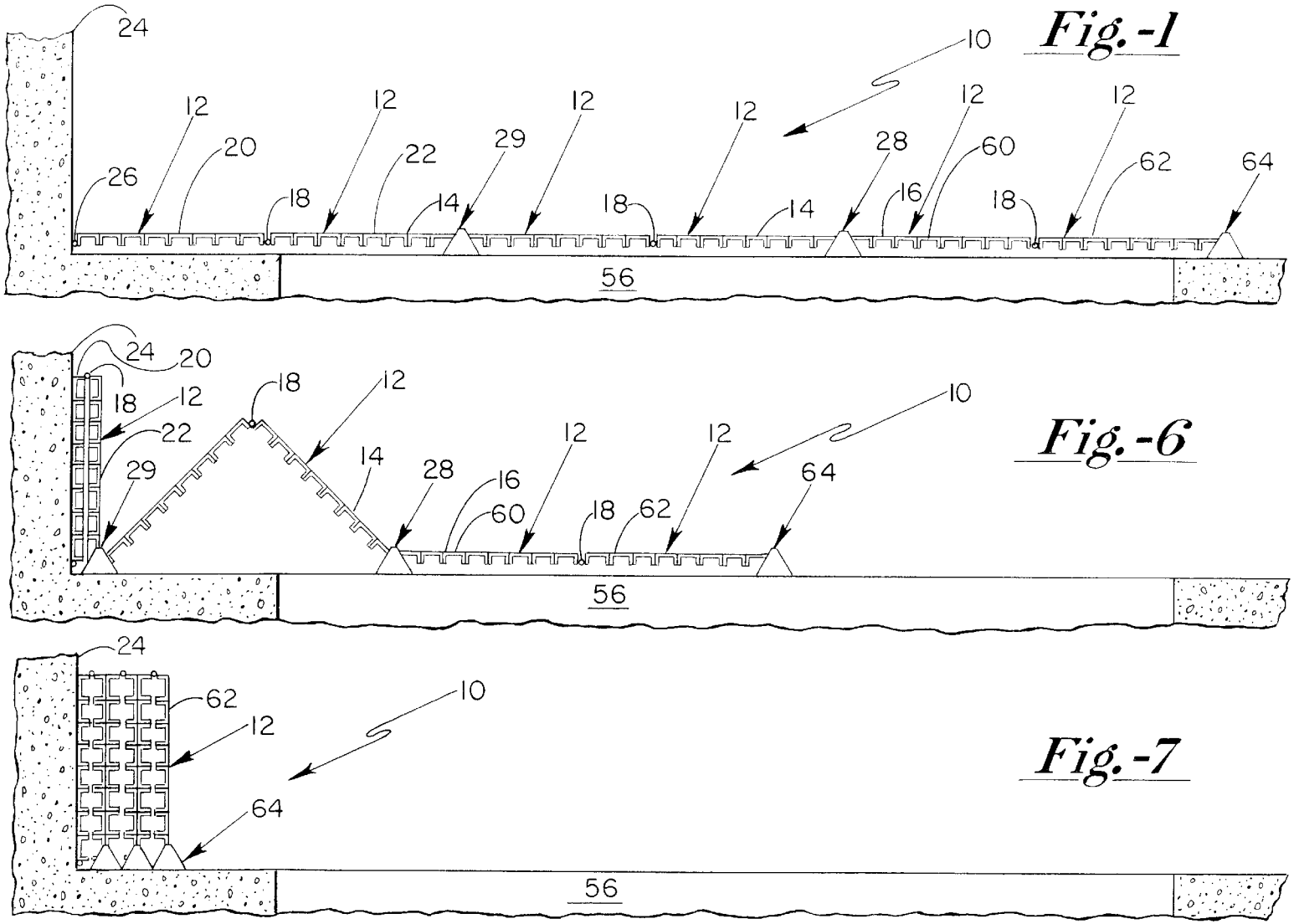
FIG. 1 is a side elevational view of the retractable load-bearing cover of the present invention in its extended position.
FIG. 6 is side elevational view of the cover shown in a partially retracted position.
FIG. 7 is a side elevational view of the cover shown in the retracted position.

With reference now to the drawings, and in particular to FIGS. 1 through 7 thereof, a new retractable load-bearing cover embodying the principles and concepts of the present invention and generally designated by the reference numeral 10 will be described.

The cover 10 includes a plurality of rigid hinged panels 12. Each panel 12 is formed by welding or otherwise attaching eight extruded aluminum beams 14 having a six inch width to form a panel 12 having a four foot width. The length of each panel 12 is dependent upon the width of the area to be covered by the cover 10. The beams 14 are attached in such manner that each panel 12 has a flat upper surface 16. An end cap 17 is welded to each lateral edge 13 of each panel 12 and provides lateral support to the panel 12.

Pairs of adjoining panels 12 are hinged together along adjoining lengths thereof by means of an extruded hinge member 18. As shown in FIG. 6, the hinge members 18 allow for the folding of the panels 12 in such manner that the flat upper surfaces 16 swing upwardly when folded. A first pair of panels 20 and 22 is shown having the first panel 20 hingedly attached to a support structure such as an upstanding wall 24 disposed adjacent the swimming pool or ice surface. The first panel 20 is hingedly attached to the wall 24 at an upper edge 26 thereof at an elevation such that the upper edge 26 thereof is coplanar with upper surfaces 16 in the cover's extended position. Alternatively, an anchor point in the plane of the floor may serve as a support structure.

Figure 2:
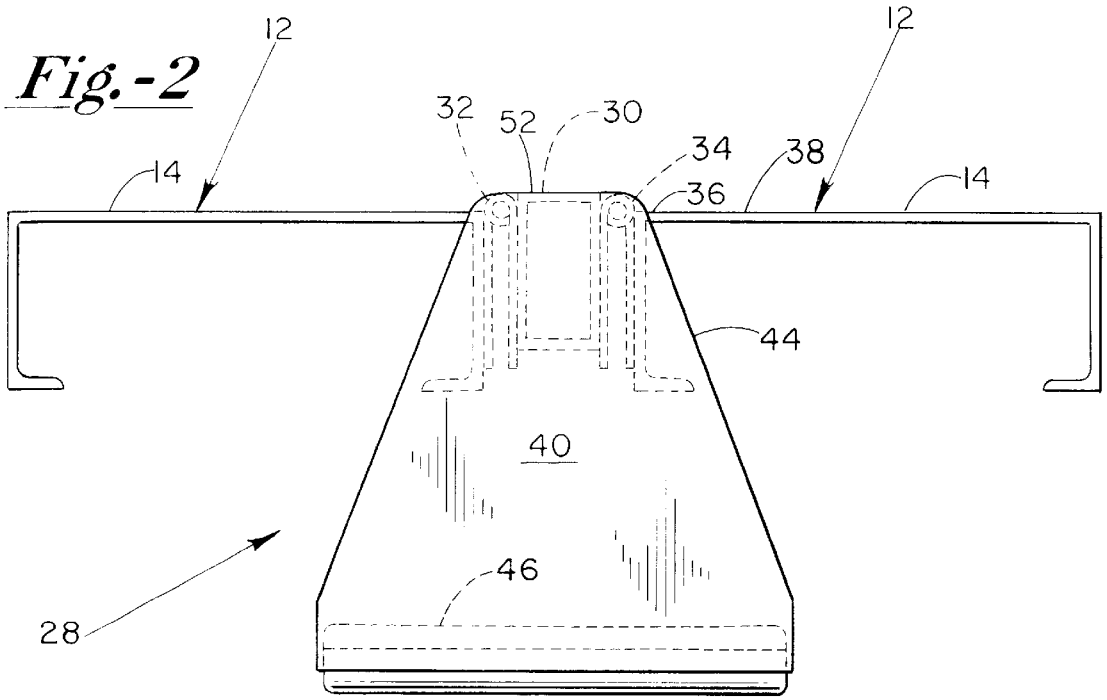
FIG. 2 is an end elevational view of an interconnecting support member.

Adjoining pairs of panels 12 are further hingedly attached to interconnecting support members 28 as shown in FIG. 2. Each interconnecting support member 28 includes a transverse tube 30 which in the preferred embodiment is an extruded aluminum tube of rectangular cross section. Integral hinge members 32 are shown formed on opposite sides of the tube 30 which hinge members 32 hingedly attach to the corresponding hinge members 34 formed on an upper edge 36 of a lateral beam 38.

Figure 3:
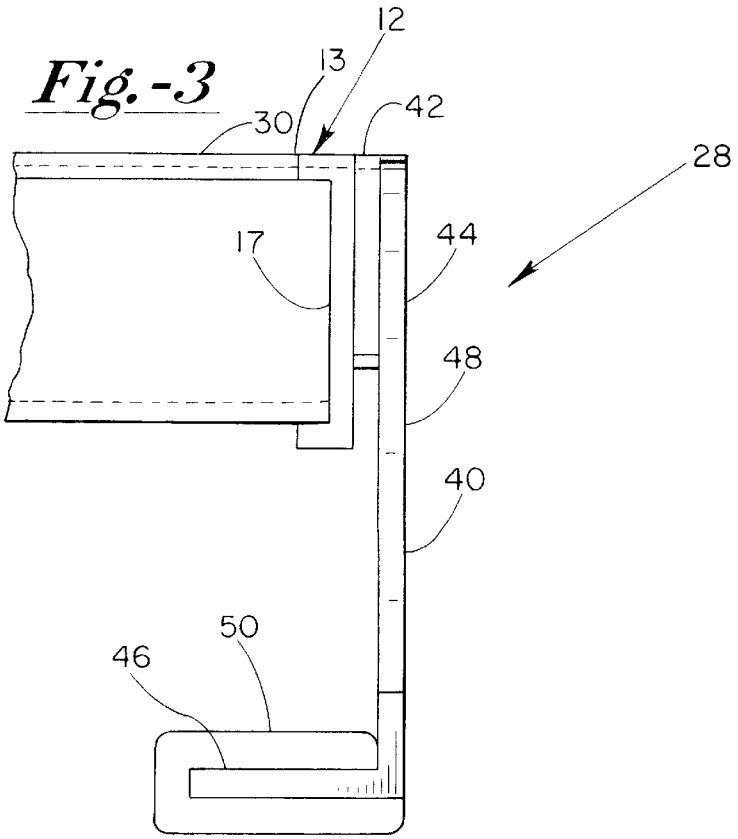
FIG. 3 is a fragmented side elevational view of the interconnecting support member.

A support plate 40 is shown in FIG. 3 fixedly attached to an end 42 of the tube 30. An identical support plate is also disposed at an opposite end of the tube 30 (not shown). The support plate 40 includes a first portion 44 attached to the end 42 of the tube 30 and a foot portion 46 angled perpendicularly to the first portion 44 and inwardly or outwardly (not shown) of a first portion outer surface 48. A polyethylene slide member 50 is fixedly attached to the foot portion 46 in surrounding relationship thereto.

With reference to FIG. 2, the panels 12 are shown to be disposed in coplanar arrangement in the cover's extended position. A tube top surface 52 extends above the plane of the panels 12. In use, a plurality of filler members such as wooden boards of sufficient height are disposed between the interconnecting support members 28 to provide for a uniformly plane surface.

Figure 4:
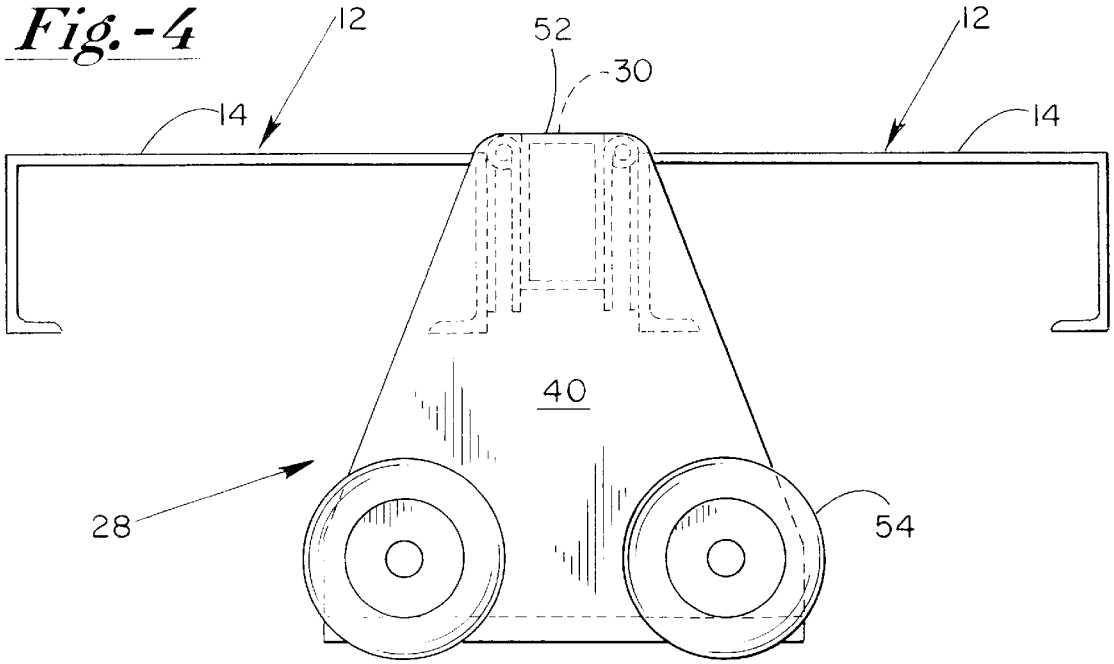
FIG. 4 is an end elevational view of an alternative embodiment of the interconnecting support member.
Figure 5:
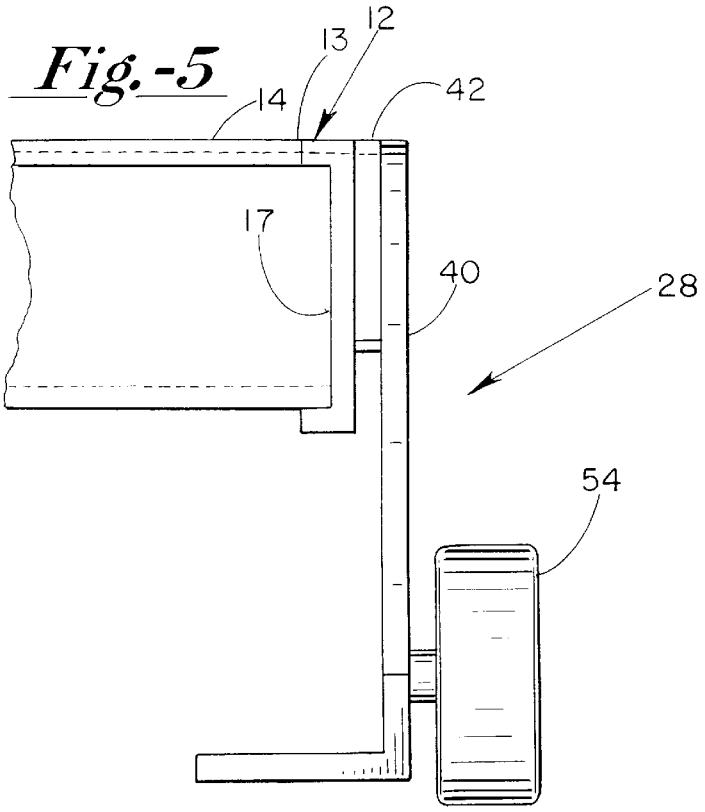
FIG. 5 is a fragmented side elevational view of the alternative embodiment of the interconnecting support member.

With reference to FIGS. 4 and 5, an alternative embodiment of the interconnecting support member is shown including a pair of wheels 54 rotatably and spacedly disposed proximate a bottom portion of the support plate 40. The wheels 54 are mounted in a conventional manner and no slide member is provided. The interconnecting support members of the alternative embodiment are in all other material respects identical to the interconnecting support members 28.

The interconnecting support members 28 support the adjoining panels 12 a distance above the surface of the swimming pool or other covered area. The support plate 40 is sized in such manner that when in use, the hinge members 32 are aligned with the hinge attaching the first panel 20 to the support structure 24. In this manner the first panel upper edge 26 is aligned with the upper surfaces 16 of the panels 12 to provide for a cover 10 which is coplanar with the pool deck or other surrounding surface.

A first interconnecting support member 29 is shown in FIGS. 1 and 6 and is in all respects identical to interconnecting support member 28. The first interconnecting support member 29 is hingedly attached to the first panel pair 20,22 and the adjoining panel pair. A terminating support member 64 is hingedly attached to a last hinged panel pair 60,62 along a length of distal panel 62. The terminating support member 64 is identical to interconnecting support member 28 in all respects except that hinges are provided only on one side thereof.

As shown in FIG. 1, in its extended position the cover 10 fully covers an area such as a swimming pool 56. The interconnecting support members 28 and 29 and the terminating support member 64 are disposed in abutting relationship to the deck of the pool and as such provide support for the adjoining panels 12.

To retract the cover 10, the first pair of adjoining panels 20 and 22 are folded about hinge member 18 and abutted to the supporting structure 24 as shown in FIG. 6. In its retracted position as shown in FIG. 7, each pair of panels 12 is folded in accordion fashion and abutted against an adjoining pair of panels 12 with the interconnecting support members 28 and 29 and the terminating support member 64 shown providing support to the panels 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A retractable load-bearing cover comprising:

a plurality of rigid panels hingedly attached one to the other to form a plurality of hinged panel pairs, adjoining hinged panel pairs being hingedly attached to an interconnecting support member;

a first hinged panel pair hingedly attachable at one end to a support structure and hingedly attachable at another end to a first interconnecting support member; and a last hinged panel pair having a distal panel hingedly attached to a terminating support member; and said interconnecting support member and said first interconnecting support member further comprising a transverse tube having a pair of opposed hinge members disposed at opposed top side portions of the transverse tube and a support plate fixedly attached to each end of the transverse tube orthogonally to the tube end, the support plate having a frictional engagement means disposed at a bottom portion of the support plate.

2. The retractable load-bearing cover of claim 1 wherein in an extended position, a plurality of hinged panel flat upper surfaces are coplanar.

3. The retractable load-bearing cover of claim 1 wherein in a retracted position, each hinged panel pair is folded about an interconnecting hinge and abutted against an adjoining panel pair in accordion configuration.

4. The retractable load-bearing cover of claim 1 wherein the frictional engagement means further comprises a polyethylene slide member fixedly attached to a bottom portion foot portion.

5. The retractable load-bearing cover of claim 1 wherein the frictional engagement means further comprises a pair of spaced wheels rotatably mounted to a bottom foot portion.

6. A retractable load-bearing cover comprising:

a plurality of rigid panels hingedly attached one to the other to form a plurality of hinged panel pairs, adjoining hinged panel pairs being hingedly attached to an interconnecting support member;

a first hinged panel pair hingedly attachable at one end to a support structure and hingedly attachable at another end to a first interconnecting support member; and a last hinged panel pair having a distal panel hingedly attached to a terminating support member; and said terminating support further comprising a transverse tube having a hinge member disposed at a top side portion of the transverse tube and a support plate fixedly attached to each end of the transverse tube orthogonally to the tube end, the support plate having a frictional engagement means disposed at a bottom portion of the support plate.

7. The retractable load-bearing cover of claim 6 wherein the frictional engagement means further comprises a polyethylene slide member fixedly attached to a bottom portion foot portion.

8. The retractable load-bearing cover of claim 6 wherein the frictional engagement means further comprises a pair of spaced wheels rotatably mounted to a bottom foot portion.

* * * * *